US006382746B1

(12) United States Patent
Rosas

(10) Patent No.: US 6,382,746 B1
(45) Date of Patent: May 7, 2002

(54) MEDICINE CABINET ASSEMBLY

(76) Inventor: Harry C. Rosas, 10808 Balboa Blvd., Granada Hills, CA (US) 91344

( * ) Notice: Subject to any disclaimer, the term of this patent is extended or adjusted under 35 U.S.C. 154(b) by 0 days.

(21) Appl. No.: 09/797,655

(22) Filed: Mar. 5, 2001

(51) Int. Cl.[7] ..... A47B 67/00
(52) U.S. Cl. ..... 312/227; 312/224; 312/242
(58) Field of Search ..... 312/224, 225, 312/226, 227, 242, 245, 209; D6/561, 568

(56) References Cited

U.S. PATENT DOCUMENTS

| | | | | |
|---|---|---|---|---|
| 2,578,096 A | * | 12/1951 | Smith | 312/227 |
| 3,244,464 A | * | 4/1966 | McMurtie et al. | 312/227 |
| 4,023,872 A | * | 5/1977 | Palka et al. | 312/226 |
| D268,382 S | | 3/1983 | Missir | |
| 4,610,489 A | | 9/1986 | Dibert, Jr. et al. | |
| 4,776,650 A | * | 10/1988 | Ferenzi | 312/224 X |
| D313,719 S | | 1/1991 | Bressler et al. | |
| 5,255,971 A | | 10/1993 | Aisley | |
| D365,718 S | | 1/1996 | Morin | |
| D397,895 S | | 9/1998 | Chen | |

FOREIGN PATENT DOCUMENTS

| | | | | |
|---|---|---|---|---|
| FR | 1219941 | * | 5/1960 | 312/227 |
| GB | 19204 | * | 9/1906 | 312/227 |

* cited by examiner

*Primary Examiner*—James O. Hansen

(57) ABSTRACT

A medicine cabinet assembly for providing a roomier medicine cabinet. The medicine cabinet assembly includes a cabinet having a middle section and end sections with the sections being separated by vertically-disposed inner walls and having open fronts and with the cabinet being mounted to a wall structure with fasteners; and also includes mirror doors being hingedly attached to the cabinet and being closable over the open fronts of the sections; and further includes drawers being removably disposed in the cabinet.

6 Claims, 3 Drawing Sheets

MEDICINE CABINET ASSEMBLY

BACKGROUND OF THE INVENTION

1. Field of the Invention

The present invention relates to a multi-sectioned medicine cabinet and more particularly pertains to a new medicine cabinet assembly for providing a roomier medicine cabinet.

2. Description of the Prior Art

The use of a multi-sectioned medicine cabinet is known in the prior art. More specifically, a multi-sectioned medicine cabinet heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,610,489; Des. 268,382; Des. 397,895; 5,255,971; Des. 313,719; and Des. 365,718.

While these devices fulfill their respective, particular objectives and requirements, the aforementioned patents do not disclose a new medicine cabinet assembly. The inventive device includes a cabinet having a middle section and end sections with the sections being separated by vertically-disposed inner walls and having open fronts and with the cabinet being mounted to a wall structure with fasteners; and also includes mirror doors being hingedly attached to the cabinet and being closable over the open fronts of the sections; and further includes drawers being removably disposed in the cabinet.

In these respects, the medicine cabinet assembly according to the present invention substantially departs from the conventional concepts and designs of the prior art, and in so doing provides an apparatus primarily developed for the purpose of providing a roomier medicine cabinet.

SUMMARY OF THE INVENTION

In view of the foregoing disadvantages inherent in the known types of multi-sectioned medicine cabinet now present in the prior art, the present invention provides a new medicine cabinet assembly construction wherein the same can be utilized for providing a roomier medicine cabinet.

The general purpose of the present invention, which will be described subsequently in greater detail, is to provide a new medicine cabinet assembly which has many of the advantages of the multi-sectioned medicine cabinet mentioned heretofore and many novel features that result in a new medicine cabinet assembly which is not anticipated, rendered obvious, suggested, or even implied by any of the prior art multi-sectioned medicine cabinet, either alone or in any combination thereof.

To attain this, the present invention generally comprises a cabinet having a middle section and end sections with the sections being separated by vertically-disposed inner walls and having open fronts and with the cabinet being mounted to a wall structure with fasteners; and also includes mirror doors being hingedly attached to the cabinet and being closable over the open fronts of the sections; and further includes drawers being removably disposed in the cabinet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new medicine cabinet assembly which has many of the advantages of the multi-sectioned medicine cabinet mentioned heretofore and many novel features that result in a new medicine cabinet assembly which is not anticipated, rendered obvious, suggested, or even implied by any of the prior art multi-sectioned medicine cabinet, either alone or in any combination thereof.

It is another object of the present invention to provide a new medicine cabinet assembly which may be easily and efficiently manufactured and marketed.

It is a further object of the present invention to provide a new medicine cabinet assembly which is of a durable and reliable construction.

An even further object of the present invention is to provide a new medicine cabinet assembly which is susceptible of a low cost of manufacture with regard to both materials and labor, and which accordingly is then susceptible of low prices of sale to the consuming public, thereby making such medicine cabinet assembly economically available to the buying public.

Still yet another object of the present invention is to provide a new medicine cabinet assembly which provides in the apparatuses and methods of the prior art some of the advantages thereof, while simultaneously overcoming some of the disadvantages normally associated therewith.

Still another object of the present invention is to provide a new medicine cabinet assembly for providing a roomier medicine cabinet.

Yet another object of the present invention is to provide a new medicine cabinet assembly which includes a cabinet having a middle section and end sections with the sections being separated by vertically-disposed inner walls and having open fronts and with the cabinet being mounted to a wall structure with fasteners; and also includes mirror doors being hingedly attached to the cabinet and being closable over the open fronts of the sections; and further includes drawers being removably disposed in the cabinet.

Still yet another object of the present invention is to provide a new medicine cabinet assembly that gives the user much more storage than any of the prior art.

Even still another object of the present invention is to provide a new medicine cabinet assembly that includes a middle section which is larger than the middle sections of any of the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
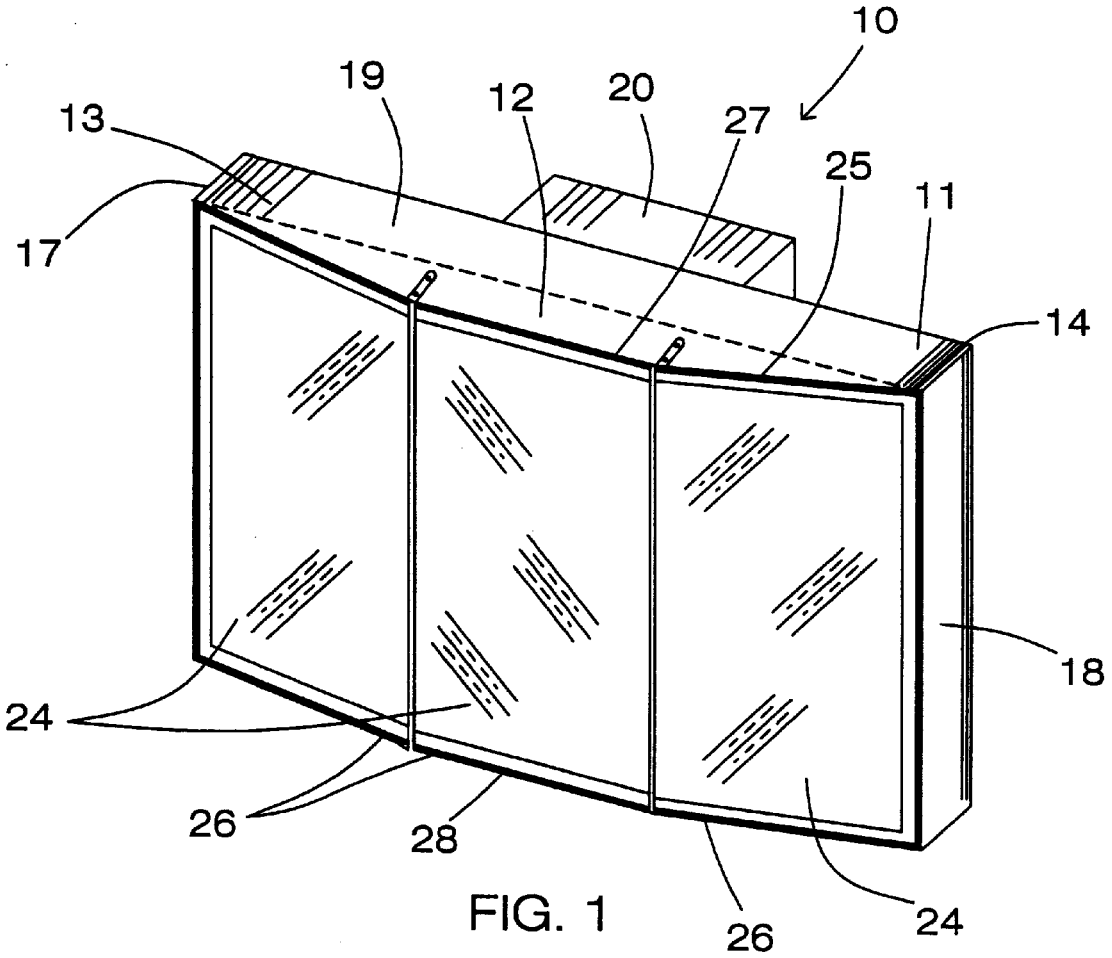
FIG. 1 is a perspective view of a new medicine cabinet assembly according to the present invention.
Figure 2:
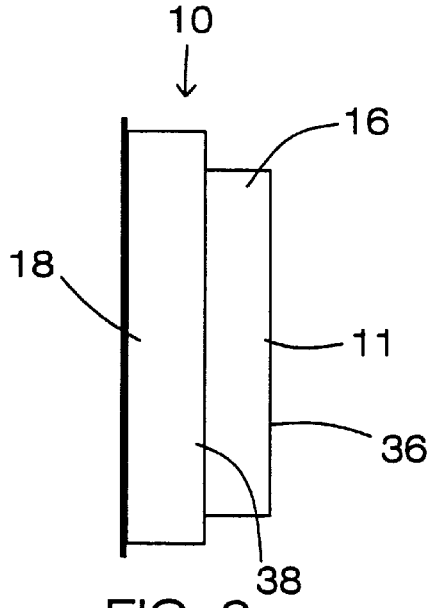
FIG. 2 is another perspective view of the present invention.
Figure 3:
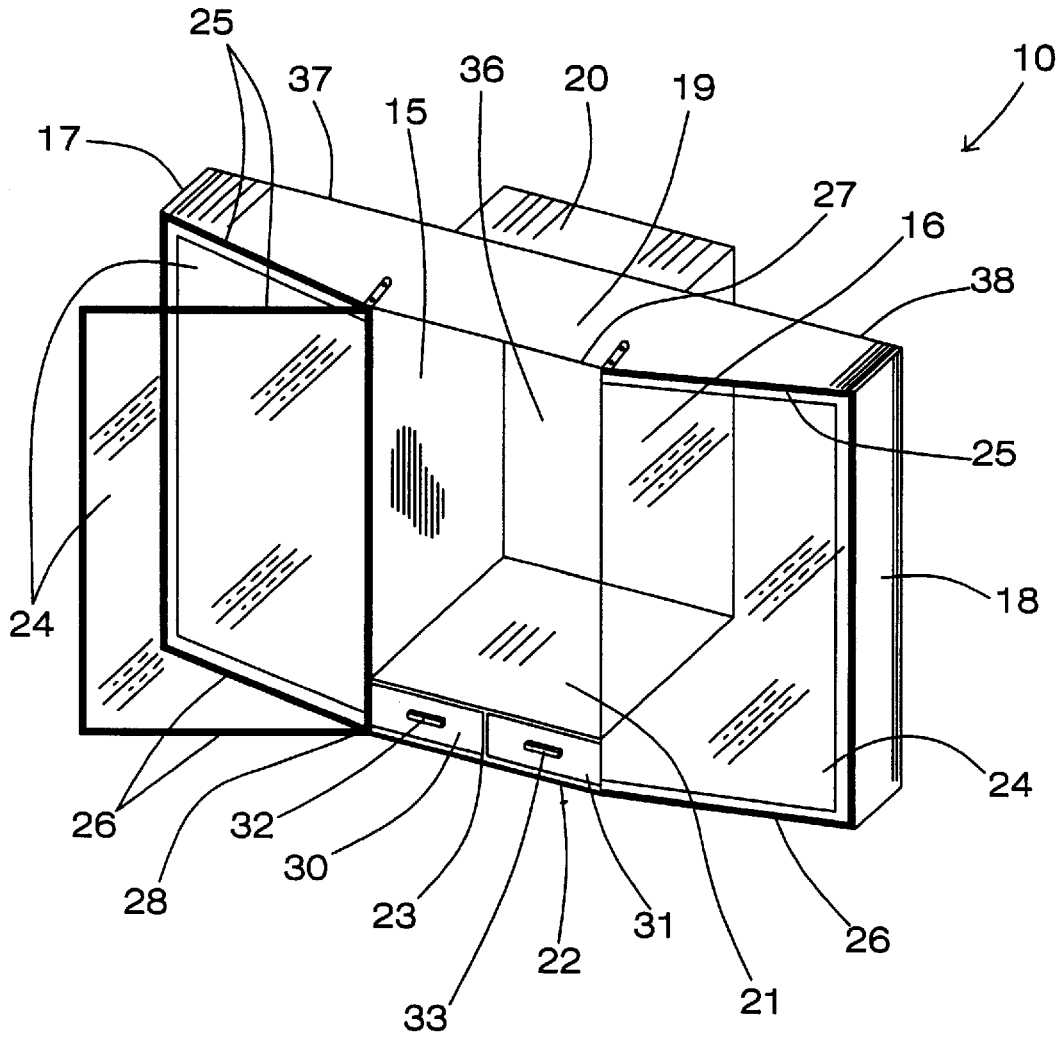
FIG. 3 is a side elevational view of the present invention.
Figure 4:
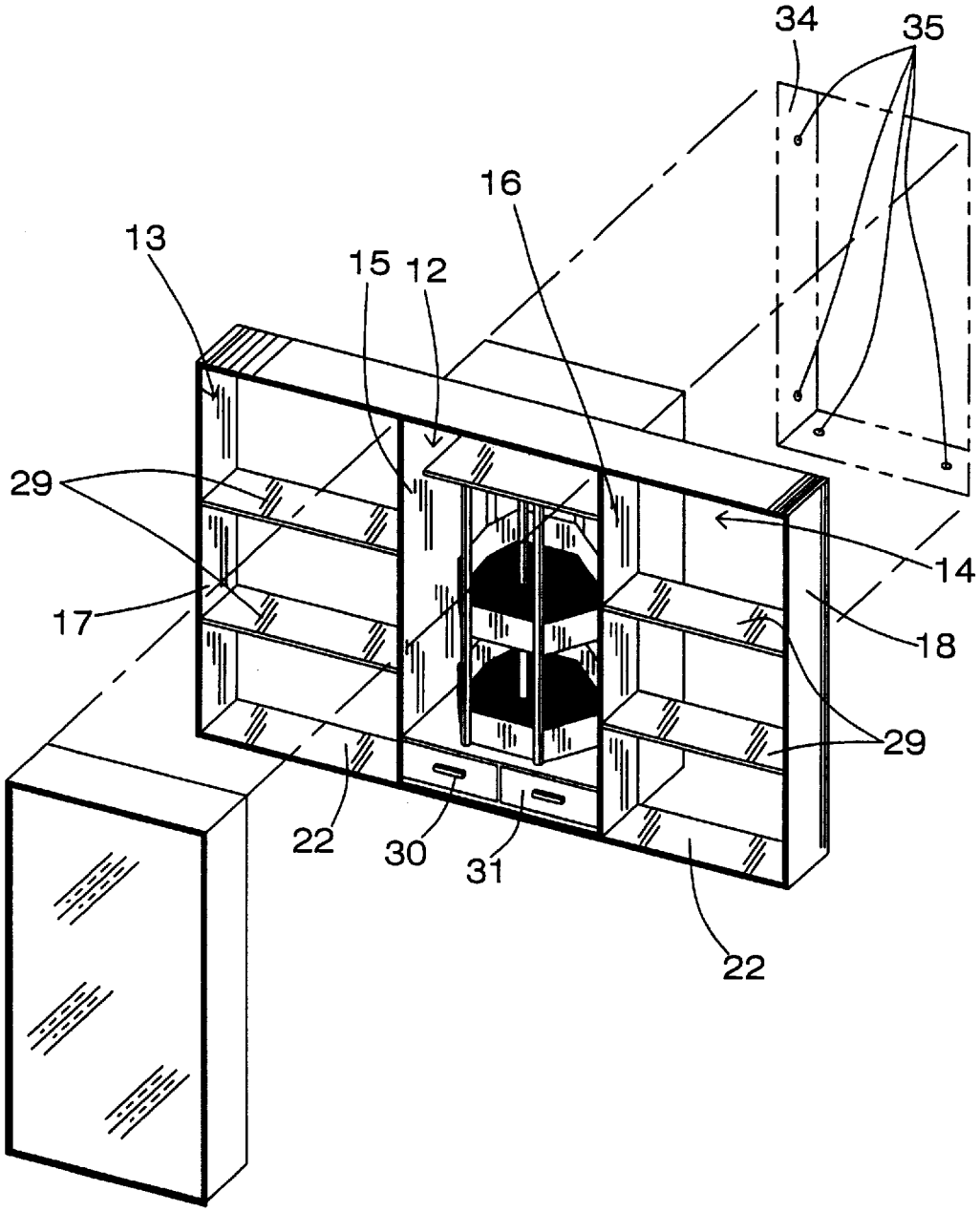
FIG. 4 is a perspective view of the present invention being installed.

With reference now to the drawings, and in particular to FIGS. 1 through 4 thereof, a new medicine cabinet assembly embodying the principles and concepts of the present invention and generally designated by the reference numeral 10 will be described.

As best illustrated in FIGS. 1 through 4, the medicine cabinet assembly 10 generally comprises a cabinet 11 having a middle section 12 and end sections 13,14. The sections 12–14 are separated by vertically-disposed inner walls 15,16 and have open fronts. The cabinet 11 is securely mounted to a wall structure 34 with fasteners 35. The cabinet 11 further includes outer side walls 17,18, back walls 36–38, top walls 19,20, and a bottom wall 22, and also includes shelves 29 being vertically spaced and being removably disposed inside the sections 12–14. The middle section 12 has a larger storage compartment than that of either of the end sections 13,14. The middle section 12 is defined by one of the back 15 walls 36 and by the inner side walls 15,16 which extend outwardly beyond the back walls 37,38 of the end sections 13,14. The middle section 12 further includes an intermediate wall 21 being horizontally disposed therein and being spaced above the bottom wall 22 and extending rearwardly beyond the bottom wall 22. The top walls 19,20 includes a main top wall 19 and a rear top wall 20 which is recessed relative to the main top wall 19. The middle section 12 further is defined by a portion of the main top wall 19 and by the rear top wall 20. The main top wall 20 and the bottom wall 22 have front edges 27,28 which are bowed or beveled forwardly of the outer side walls 17,18. The cabinet 11 further includes a divider 23 vertically disposed between the intermediate wall 21 and the bottom wall 22 in the middle section 12. The cabinet 11 has a width of approximately 33 inches, and a height of approximately 29 inches. The middle section 12 has a width of approximately 13.5 inches.

Mirror doors 24 are hingedly and conventionally attached to the cabinet 11 are being closeable over the open fronts of the sections 12–14. The mirror doors 24 have top and bottom edges 25,26 which are hingedly attached to the inner side walls 15,16 for closing over the fronts of the sections 12–14.

Drawers 30,31 are removably disposed in the cabinet 11. The drawers 30,31 are removably disposed between the bottom wall 22 and the intermediate wall 21 in the middle section 12 and have handle members 33 being securely and conventionally attached to exteriors of front walls of said drawers 30,31.

In use, the user fastens the cabinet 11 to the wall structure 34 using the fasteners 34 and uses the cabinet 11 to store medicines and bathroom toiletry items. This cabinet 11 gives the user much more storage over the conventional medicine cabinets.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medicine cabinet assembly comprising: a cabinet having a middle section and end sections, said sections being separated by vertically-disposed inner walls and having open fronts, said cabinet being mounted to a wall structure with fasteners, said cabinet further including outer side walls, back walls, top walls, and a bottom wall, and also including shelves being vertically spaced and removably disposed in said sections, said middle section having a larger storage compartment than that of either of said end sections, said middle section being defined by one of said back walls and by said inner walls which extend outwardly beyond said back walls defining said end sections, said middle section further including an intermediate wall being horizontally disposed therein and being spaced above said bottom wall and extending rearwardly beyond said bottom wall, said top walls including a main top wall and a rear top wall which is recessed relative to said main top wall, said middle section further being defined by a portion of said main top wall and by said rear top wall;

mirror doors being hingedly attached to said cabinet and being closeable over said open fronts of said sections; and drawers being removably disposed in said cabinets.

2. A medicine cabinet assembly as described in claim 1, wherein said main top wall and said bottom wall have front edges which are bowed or beveled forwardly of said outer side walls.

3. A medicine cabinet assembly as described in claim 2, wherein said cabinet further includes a divider vertically disposed between said intermediate wall and said bottom wall in said middle section.

4. A medicine cabinet assembly as described in claim 3, wherein said mirror doors have top and bottom edges which are hingedly attached to said inner walls for closing over said fronts of said sections.

5. A medicine cabinet assembly as described in clam 3, wherein said drawers are removably disposed between said bottom wall and said intermediate wall in said middle section and have handle members being securely attached to exteriors of front walls of said drawers.

6. A medicine cabinet assembly comprising;

a cabinet having a middle section and end sections, said sections being separated by vertically-disposed inner walls and having open fronts, said cabinet being mounted to a wall structure with fasteners, said cabinet further including outer side walls, back walls, top walls, and a bottom wall, and also including shelves being vertically spaced and being removably disposed in said sections, said middle section having a larger storage compartment than that of either of said end sections, said middle section being defined by one of said back walls and by said inner walls which extend outwardly beyond said back walls defining said end sections, said middle section further including an intermediate wall being horizontally disposed therein and being spaced above said bottom wall and extending rearwardly beyond said bottom wall, said top walls including a main top wall and a rear top wall which is recessed relative to said main top wall, said middle section further being defined by a portion of said main top wall and by said rear top wall, said main top wall and said bottom wall having front edges which are bowed or beveled forwardly of said outer side walls, said cabinet further including a divider vertically disposed between said intermediate wall and said bottom wall in said middle section, said cabinet having a width of approximately 33 inches, and a height of approximately 29 inches, said middle section having a width of approximately 13.5 inches;

mirror doors being hingedly attached to said cabinet and being closeable over said open fronts of said sections, said mirror doors having top and bottom edges which are hingedly attached to said inner walls for closing over said fronts of said sections; and drawers being removably disposed in said cabinet, said drawers being removably disposed between said bottom wall and said intermediate wall in said middle section and having handle members being securely attached to exteriors of front walls of said drawers.

* * * * *